US005941709A

United States Patent [19]

Denchfield

[11] Patent Number: 5,941,709

[45] Date of Patent: Aug. 24, 1999

[54] WEAPON SIMULATOR

[75] Inventor: Clifford Denchfield, Ellington, United Kingdom

[73] Assignee: Lockheed Martin Tactical Systems U.K. Limited, Hertfordshire, United Kingdom

[21] Appl. No.: 08/930,113

[22] PCT Filed: May 8, 1996

[86] PCT No.: PCT/GB96/01091

§ 371 Date: Feb. 23, 1998

§ 102(e) Date: Feb. 23, 1998

[87] PCT Pub. No.: WO96/35920

PCT Pub. Date: Nov. 14, 1996

[30] Foreign Application Priority Data

May 10, 1995 [GB] United Kingdom ..... 9509490

[51] Int. Cl.[6] ..... F41A 33/00

[52] U.S. Cl. ..... 434/16; 434/11; 89/7

[58] Field of Search ..... 434/16, 11; 89/7

[56] References Cited

U.S. PATENT DOCUMENTS 4,326,847 4/1982 Roe ..... 434/12

4,561,848 12/1985 Freeney, Jr. et al. ..... 434/18

5,180,878 1/1993 Denchfield ..... 89/7

5,396,844 3/1995 Hessey ..... 102/355

5,646,363 7/1997 Denchfield ..... 89/7

*Primary Examiner*—Jessica J. Harrison

*Assistant Examiner*—David A. Fleming

*Attorney, Agent, or Firm*—Townsend and Townsend and Crew, LLP

[57] ABSTRACT

A simulated ammunition round (1) is characterised by a gunfire simulator (4) having a combustion chamber (28), means (21) for admitting fuel gas to the combustion chamber, ignition means (23) for igniting fuel gas in the combustion chamber to cause an explosion and an exhaust port (51) in the combustion chamber. The simulated ammunition round may comprise outlet valve means (14), e.g. a collapsible or frangible diaphragm, for closing the exhaust port and arranged to open rapidly and with audible results in response to explosive pressure rise within the combustion chamber. The simulated ammunition round may comprise means (38, 41) to enable firing of the round, the enabling means being responsive to loading of the round into the receiving chamber of a weapon.

6 Claims, 2 Drawing Sheets

WEAPON SIMULATOR

TECHNICAL FIELD

The invention relates to a weapon simulator for use for example in gunnery or weapons training to simulate the sound of gunfire, and more particularly a practice or simulated ammunition round for use in training or in battlefield simulation.

BACKGROUND ART

It is known to provide gunfire simulators which simulate the flash and noise of a gun being fired or the strike of an explosive projectile. At their simplest such gunfire simulators may be no more than blank cartridges which directly take the place of live ammunition. However for use in simulating the firing of battlefield weapons from small arms through missile launchers to heavy guns such as tank guns and field artillery it is known to provide pyrotechnic devices which are housed in a metal block which may, for example, hold 12,20 or 24 rounds and which is fixed to the exterior of the weapon platform close to the barrel of the weapon in question. Usually the weight of such devices is such that they cannot be fixed directly to the barrel of the weapon. Often the devices are sufficiently bulky to create an obstruction to the sight of the tank or gun crew. Since such devices are limited to a relatively small number of rounds, a lack of realism can result. Also the cost of the pyrotechnic devices, while being much less than that of live ammunition, is nevertheless appreciable.

Our U.K. patent GB-B-2250333 discloses a gunfire simulator intended to address these problems and comprising a combustion chamber, means for admitting fuel gas to the combustion chamber, ignition means for igniting fuel gas in the combustion chamber to cause an explosion, an exhaust port in the combustion chamber and outlet valve means for closing the exhaust port and arranged to open rapidly and with audible results in response to explosive pressure rise within the combustion chamber. Outlet valve means comprising a frangible diaphragm is specifically disclosed.

In the gunfire simulator disclosed in U.K. patent GB-B-2250333, the diaphragm may be part of a web, tape or ribbon of the thin sheet extending across the exhaust port and which is movable to position a fresh section of the sheet to close the exhaust port between one explosion and the next, and the simulator comprises means for feeding a fresh section of the web to the exhaust port after each explosion, and an automatic breechblock mechanism for releasably clamping a fresh section of the sheet in position during each explosion.

It is an object of the invention to provide a novel practice or simulated round of ammunition.

DISCLOSURE OF INVENTION

The invention provides a simulated ammunition round characterised by a gunfire simulator having a combustion chamber, means for admitting fuel gas to the combustion chamber, ignition means for igniting fuel gas in the combustion chamber to cause an explosion and an exhaust port in the combustion chamber. The simulated ammunition round may comprise outlet valve means for closing the exhaust port and arranged to open rapidly and with audible results in response to explosive pressure rise within the combustion chamber. The outlet valve means may comprise a collapsible diaphragm having a peripheral edge and a breechblock mechanism for releasably gripping the peripheral edge of the diaphragm.

Thus the round may simulate a live round in general shape and size and will be adapted to be loaded into a weapon whereby on firing the weapon the dummy round will be operated to simulate gunfire. The dummy round may be provided with means, which may be in the form of a tilt or attitude or motion-sensing or proximity switch whereby the dummy round cannot be 'fired' without first removing it from, and replacing it in, the receiving chamber of the weapon between firings. This is to ensure that a weapons operator must correctly complete the appropriate weapon loading and unloading procedure between successive firings. In this connection it is conceivable that the dummy round might generate a sufficient level of sound for gunnery practice and simulation without use of a collapsible or frangible diaphragm in view of the fact that the dummy round is operated in the enclosed environment of the chamber of a weapon.

The simulated ammunition round may comprise a weapon simulator as described and claimed in our co-pending International patent application of even date herewith and claiming priority from our U.K. patent application GB9509490.0 dated May 10, 1995. The simulated ammunition round may employ a collapsible or frangible diaphragm as described and claimed in our co-pending International patent application of even date herewith and claiming priority from our U.K. patent application GB9509490.0 dated May 10, 1995.

BRIEF DESCRIPTION OF DRAWINGS

The invention is diagrammatically illustrated, by way of example in the accompanying drawings in which.

BEST MODE FOR CARRYING OUT THE INVENTION

Figure 1:
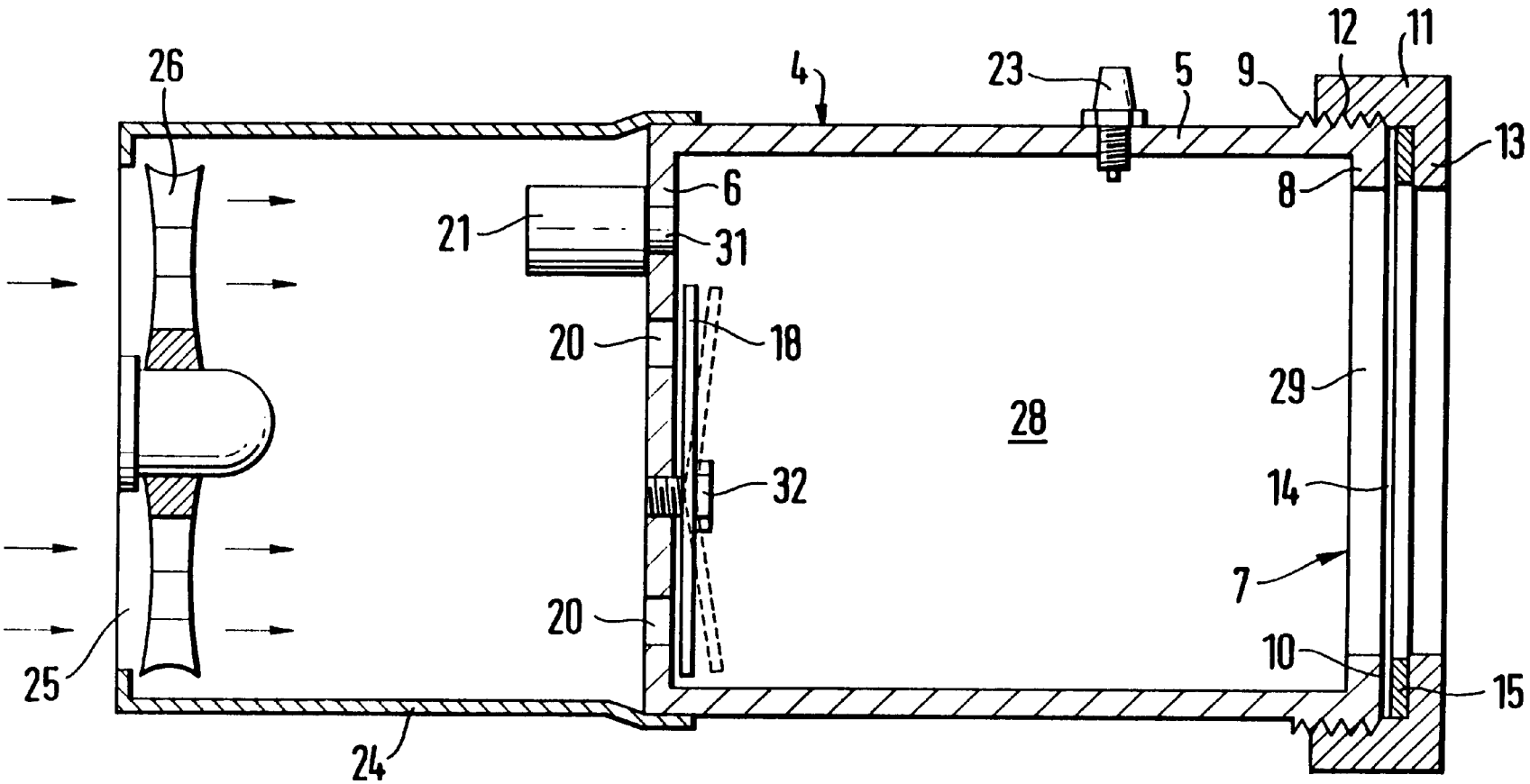
FIG. 1 is a cross-sectional side elevation of a single shot weapon simulator as described and claimed in our co-pending International patent application of even date herewith and claiming priority from U.K. patent application GB9509490.0 dated May 10, 1995.

FIG. 1 of the drawings illustrates a single shot breechblock mechanism for a gunfire or weapon simulator generally of the kind described in our U.K. patent GB-B-2250333. In FIG. 1 a gunfire simulator 4 intended for use in battlefield weapons training comprises a generally cylindrical combustion chamber 28 defined by a cylindrical wall 5 bounded at one end by an end wall 6. The cylindrical wall 5 carries a spark plug 23 which projects into the chamber 28. Although not shown in the drawing, the electrodes of the spark plug preferably extend into the combustion chamber so that ignition occurs centrally. The end wall 6 carries a gas solenoid valve 21 which communicates with the interior of the chamber 28 through an inlet port 31. The end wall 6 is also formed with air inlet ports 20 which communicate between atmosphere and the chamber 28. The ports 20 are controlled by a flap valve 18 disposed within the chamber 28 adjacent to the end wall 6 and in the form of a resilient disc of a material such as synthetic rubber clamped to the wall 6 by fastening means 32 to close the ports 20 as shown in full lines, but capable of resilient deflection into the position shown in dotted lines to allow air into the combustion chamber.

The end 7 of the combustion chamber opposite to end wall 6 carries an inwardly projecting flange 8 which defines a circular aperture 29 which acts as an exhaust port communicating between the combustion chamber and atmosphere. The flange 8 also defines an axial end face 10. The end 7 of the combustion chamber is formed externally with screw threads 9. An annular member 11 is formed with internal screw threads 12 for mating engagement with the external screw threads 9 on the end 7 of the combustion chamber whereby the annular member 11 can be removably secured on the end of the combustion chamber to form a breechblock mechanism.

As an alternative to the screw-threaded engagement the annular member 11 may be releasably coupled to the end 7 of the combustion chamber by means of a bayonet coupling known per se. This will have the beneficial effect of providing positive stop means for preventing unintentional overtightening of the breechblock, which may occur with a screw-threaded breechblock.

The annular member 11 is formed at one end with an inwardly projecting flange 13 corresponding in diameter to that of the flange 8 of the combustion chamber. A disc-like collapsible diaphragm 14 described more fully below is shown releasably clamped between the end face 10 of the combustion chamber and the flange 13 of the annular member 11, with the interposition of a resilient ring 15 between the diaphragm 14 and the flange 13 of the annular member 11 for the purpose appearing below.

The end 6 of the combustion chamber is continued rearwardly by a generally cylindrical housing 24 formed with an open end 25 in which is mounted a fan or a blower 26 which is used to force air into the combustion chamber via the inlet ports 20.

In operation of the simulator device, fuel gas, e.g. a mixture of propane and butane, is admitted to the combustion chamber 28 through the gas valve 21 and combustion air is blown into the combustion chamber through the ports 20 by the fan 26, during which period the flap valve 18 deforms into the position shown in dotted lines. The fuel/air mixture is then ignited by means of the spark plug 23 so that pressure within the combustion chamber rises rapidly. This rise in pressure causes the inlet valve 18 to close, i. e. assume the position shown in full lines. When the pressure reaches a given level the diaphragm 14 will collapse and in collapsing will become detached from the breechblock to allow the combustion gases to escape through the exhaust port 29 thus causing the characteristic flash and bang of a fired weapon or explosive strike. The diaphragm, which acts as an exhaust valve, releases as quickly as possible to give a sharp report. The fan or blower 26 preferably operates continuously so that when the pressure in the chamber 28 drops, the inlet valve 18 opens so that air is admitted to the combustion chamber to purge the exhaust gases via the open exhaust port.

As indicated above, the annular ring member 11 and the end 10 of the combustion chamber together form a breechblock mechanism for releasably clamping the disc-like diaphragm 14, which forms outlet valve means to close the combustion chamber. This is achieved by resiliently clamping the peripheral edge of the diaphragm 14 between the opposed pair of flanges 8 and 13 with the interposition of the elastic ring 15 so that the diaphragm is expelled intact from the combustion chamber when an adequate pressure rise takes place, caused by the explosive combustion of a fuel/air mixture. In a preferred implementation, the elastic ring 15 is of neoprene rubber and the threaded clamp ring 11 is tightened against a mechanical stop to control the compression force on the elastic ring 15. When explosive combustion takes place in the chamber, the sudden rise in internal pressure causes the diaphragm to deform sufficiently to be released by the clamping mechanism formed by the threaded ring, the elastic ring 15 and the rim 10 of the combustion chamber, so that the diaphragm is expelled from the combustion device intact and in doing so generates the desired noise effect.

Figure 2:
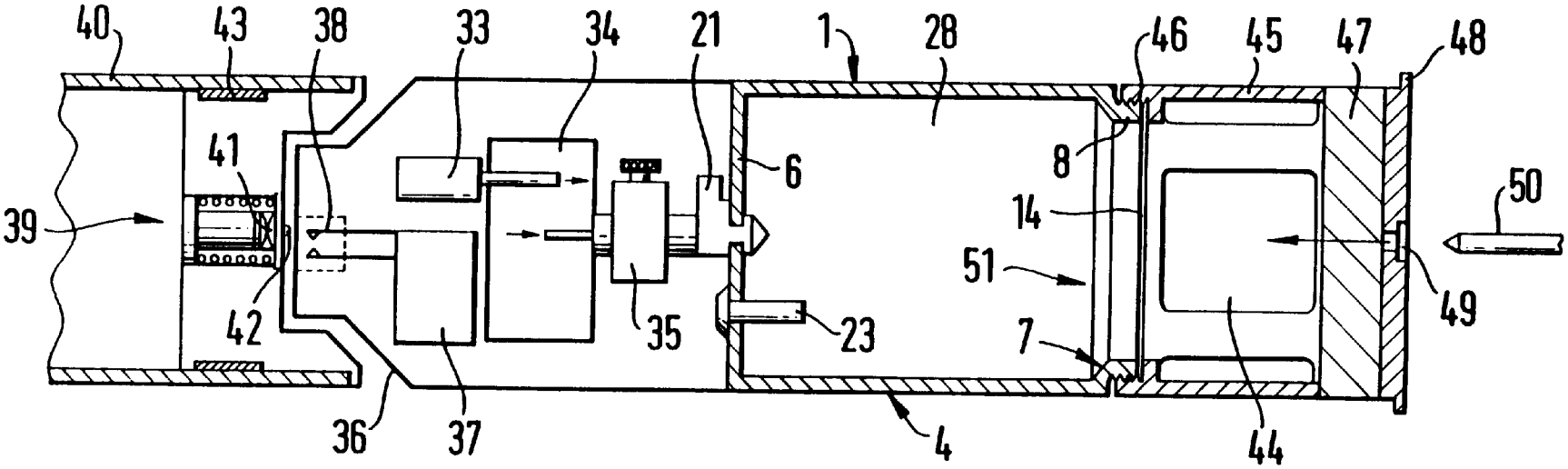
FIG. 2 is a cross-sectional side view of a dummy round of ammunition incorporating a gunfire simulator generally of the kind shown in FIG. 1 of the drawings accompanying our co-pending International patent application of even date herewith and claiming priority from U.K. application GB9509490.0 dated May 10, 1995.

In FIG. 2 there is shown a dummy or simulated round 1 of ammunition, e.g. for use in gunnery practice or drill, and incorporating a gunfire simulator 4 generally of the kind shown in FIG. 1. The dummy round 1 resembles a real ammunition round in general shape and size and thus is of elongate generally cylindrical shape.

In FIG. 2 the simulated ammunition round 1 comprises a cylindrical combustion chamber 28 defined by end wall 6 which carries a spark plug 23 projecting into the chamber. The end wall 6 also carries a gas solenoid valve 21 which communicates with the interior of the chamber 28. A fuel cell 33, e.g. a tank of fuel gas under pressure, is arranged to vent gas into a reservoir 34 which communicates with the valve 21 via a gas regulator 35.

The nose end 36 of the round 1 houses electric circuitry including an ignition generator, incorporated for example on a printed circuit board 37 operatively associated with a magnetic reed switch 38 which is arranged to be activated by a proximity actuator 39 positioned in the barrel 40 of a gun (not shown) on which the simulation or practice is to be performed. The actuator 39 comprises a magnet 41 stationarily mounted in the gun barrel 40 and a point contact 42 adapted to make electrical contact with the dummy round 1 at the same potential as that of the gun barrel 40. The actuator 39 is mounted in the barrel 40 by means of a friction band 43.

The end 7 of the combustion chamber opposite to the end wall 6 carries a flange 8 defining an exhaust port 51 which vents to atmosphere via apertures 44 in a hollow generally cylindrical member 45 releasably fixed to the combustion chamber 28, e.g. by screw-threaded means 46. A collapsible or frangible diaphragm 14 is held between the chamber 28 and the member 45 generally in the manner and for the purpose described above with reference to FIG. 1.

The member 45 is closed at one end by an insulator block 47 which carries an end plate 48 for the round 1. Centrally of the end plate 48 is arranged a depression 49 simulating a percussion cap and which is arranged to be struck by a firing pin or striker 50 on the gun. The parts 49 and 50 are arranged to provide an electrical earth return for the simulated round.

The operation of the dummy round 1 is generally similar to that described above with reference to FIG. 1 and with reference to the gunfire simulator of U.K. patent GB 2250333. One difference is in the means for triggering the explosion. With the dummy round withdrawn from the field of the magnet 41, the reed switch 38 is open, so that the simulator is inert. Another difference is in the fact that the gunfire simulator incorporated in the simulated or dummy round of the present invention does not incorporate means for forcing combustion air into the combustion chamber. The combustion chamber is purged of combustion gases and fresh air is supplied during removal and replacement of the round from the gun between firings, and under the effects of the vacuum created by the explosion.

To load the dummy round, the breech of gun is opened and the dummy round is inserted in the normal way. This causes the magnetic field of magnet to operate the reed switch 38 to provide electrical power to the round. At the same time the contact 42 connects the electrical circuitry 37 to the barrel potential. The dummy round is now ready to fire. When the firing pin 50, which is at barrel potential makes contact with the round, the following firing sequence is initiated:

(1) gas solenoid 21 delivers a measured charge of gas to the combustion chamber 28;

(2) ignition generator 37 delivers a spark to the plug 23;

(3) combustion occurs, and (4) diaphragm disc 14 is expelled through ports 44 to simulate the sound of gunfire.

Industrial Applicability

The invention thus provides a novel simulated or practice ammunition round.

I claim:

1. A simulated ammunition round of the kind adapted to be loaded into the breech of a gun characterized by a gunfire simulator having a combustion chamber, means for admitting fuel gas to the combustion chamber, ignition means for igniting fuel gas in the combustion chamber to cause an explosion and an exhaust port in the combustion chamber, and by means to enable firing of the round, the enabling means being responsive to loading of the round into the receiving chamber of the gun.

2. A simulated ammunition round according to claim 1, characterized by outlet valve means for closing the exhaust port and arranged to open rapidly and with audible results in response to explosive pressure rise within the combustion chamber.

3. A simulated ammunition round according to claim 2, characterized in that the outlet valve means comprises a collapsible diaphragm having a peripheral edge and by a breechblock mechanism for releasably gripping the peripheral edge of the diaphragm.

4. A simulated ammunition round according to claim 1, characterized in that enabling means comprises a proximity switch.

5. A simulated ammunition round which is adapted to be loaded into the breech of a gun, wherein the round comprises:

a gunfire simulator having a combustion chamber, a mechanism to admit fuel gas to the combustion chamber, an ignition system to ignite fuel gas in the combustion chamber to cause an explosion and an exhaust port in the combustion chamber, wherein the gunfire simulator further includes a percussion cap and a fire enabling mechanism separate from the percussion cap to enable firing of the round such that the simulator is actuated by striking of the percussion cap after enabling the fire enabling mechanism by loading the round into the receiving chamber of the gun.

6. A simulated ammunition round according to claim 5, wherein the enabling mechanism comprises a proximity switch.

* * * * *